United States Patent [19]

Makosa

[11] Patent Number: 4,969,500

[45] Date of Patent: Nov. 13, 1990

[54] WIND SCREEN APPARATUS

[76] Inventor: Seweryn S. Makosa, 104 Crownpointe Dr., Vallejo, Calif. 94591

[21] Appl. No.: 439,154

[22] Filed: Nov. 20, 1989

[51] Int. Cl.[5] ..... E04H 15/00

[52] U.S. Cl. ..... 160/135; 160/127; 135/902; 5/417

[58] Field of Search ..... 160/135, 237, 127, 10; 135/96, 87, 902, DIG. 10, 120, 91; 5/417, 418, 419, 420, 508

[56] References Cited

U.S. PATENT DOCUMENTS

| | | | |
|---|---|---|---|
| 2,036,033 | 3/1936 | Fisher . | |
| 2,190,566 | 2/1940 | Julian . | |
| 2,518,167 | 8/1950 | Mintz | 135/120 X |
| 2,619,101 | 11/1952 | McGerry et al. | 135/87 |
| 2,816,559 | 12/1957 | Kuhar | 135/91 X |
| 2,882,913 | 4/1959 | Beauregard | 135/87 X |
| 2,970,600 | 2/1961 | Schultz | 135/87 X |
| 2,981,256 | 4/1961 | Besnah . | |
| 3,498,587 | 3/1970 | Freidberg . | |
| 3,537,688 | 11/1970 | Stein | 135/902 X |
| 4,499,133 | 2/1985 | Prince | 5/417 X |
| 4,512,049 | 4/1985 | Henry | 5/417 |
| 4,599,754 | 7/1986 | Mains, III et al. . | |
| 4,838,525 | 6/1989 | Snow et al. | 135/87 X |
| 4,860,777 | 8/1989 | Orlando | 135/87 |

*Primary Examiner*—David M. Purol

*Attorney, Agent, or Firm*—Leon Gilden

[57] ABSTRACT

A wind screen apparatus is set forth wherein a plural series of screen sections are provided with post members secured therebetween. The screen sections include cylindrical pockets orthogonally aligned relative to the longitudinal extent of each screen section for securely receiving an associated post therein. Each post includes a pointed lowermost end for securement each post into a soil or sand support. The screen organization further includes electrical line and illumination members mounted on each screen section for illumination of each screen section for visibility during periods of limited light condition, such as during the evening hours. Further, a support member with handles mounted on each end thereof is provided for transport of the apparatus when the apparatus is inter-rolled about itself.

2 Claims, 5 Drawing Sheets

PRIOR ART

FIG 3
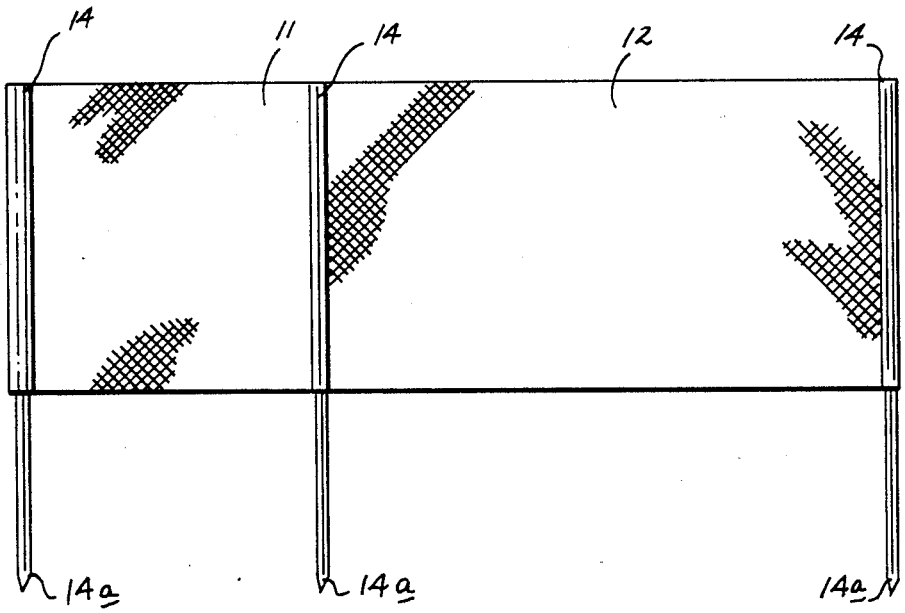
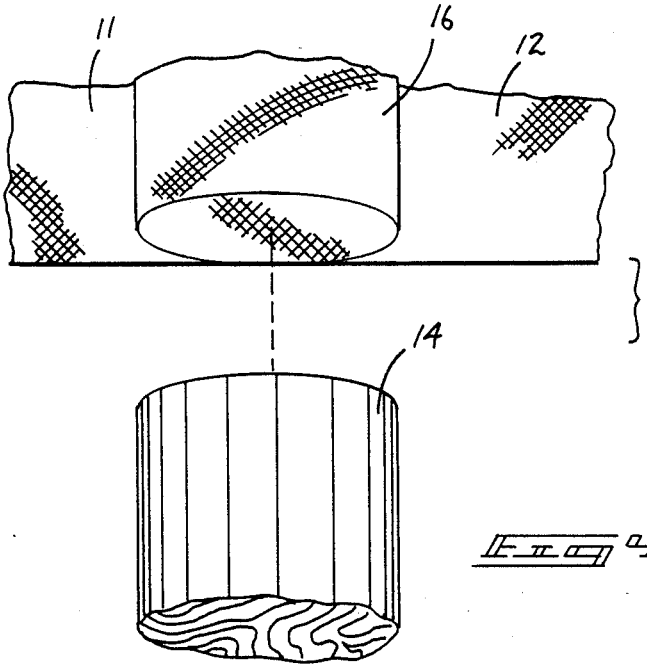
FIG 4

12
13
14
14a
16
20
21
22
23
24
25
26
27
28
29
30

WIND SCREEN APPARATUS

BACKGROUND OF THE INVENTION

1. Field of the Invention

The field of invention relates to wind screen apparatus, and more particularly pertains to a new and improved wind screen apparatus wherein the same is readily assembled to provide a secure and rigid screen environment.

2. Description of the Prior Art

The use of wind screen apparatus in various outdoor environments, and particular beach environments, is known in the prior art. The use of wind screens is desirable to prevent undesirable wind from disrupting an associated blanket and directing debris and the like onto a user thereof. The instant invention attempts to overcome deficiencies of the prior art by providing a wind screen apparatus of enhanced durability and further prevent encroachment onto an associated blanket and enabling positioning of the wind screen as desired about an associated blanket. Examples of the prior art include U.S. Pat. No. 4,599,754 to Mairs sets forth a plurality of separate screen sections independent of one another and insertable within apertures of an associated blanket. The Mairs patent inherently does not maximize use of the blanket due to the apertures therethrough, as well as encroaching upon the surface of the blanket minimizing its area of use. Further, the screen sections are independent and do not completely shield when in their securement to the blanket.

U.S. Pat. No. 3,498,587 to Friedberg sets forth a collapsible enclosure formed as an interfoldable series of panels with securement members to secure the panels in an edge to edge relationship to provide an encompassing enclosure.

U.S. Pat. No. 2,190,566 to Julian sets forth a beach shield wherein the shield utilizes a foldable canopy to overlie a flexible support to provide a degree of protection thereto.

U.S. Pat. No. 2,036,033 to Fisher provides a pivotally mounted framework with a fabric secured thereto to enable extension and retraction of the so-formed canopy overlying a support.

U.S. Pat. No. 2,981,256 to Besnah provides an interfoldable protective shield formed of pivotally mounted panels that are positionable about a medially positioned support.

As such, it may be appreciated that there is a continuing need for a new and improved wind screen apparatus which addresses both the problems of ease of use and effectiveness in construction, and in this respect, the present invention substantially fulfills this need.

SUMMARY OF THE INVENTION

In view of the foregoing disadvantages inherent in the known types of wind screen apparatus now present in the prior art, the present invention provides a wind screen apparatus wherein the same provides a continuous wind screen member for selective positioning in association with a blanket and further utilizes illumination means to enhance visibility. As such, the general purpose of the present invention, which will be described subsequently in greater detail, is to provide a new and improved wind screen apparatus which has all the advantages of the prior art wind screen apparatus and none of the disadvantages.

To attain this, the wind screen apparatus includes a wind screen apparatus wherein a plural series of screen sections are provided with post members secured therebetween. The screen sections include cylindrical pockets orthogonally aligned relative to the longitudinal extend of each screen section for securely receiving an associated post therein. Each post includes a pointed lowermost end for securement of each post into a soil or sand support. The screen organization further includes electrical line and illumination members mounted on each screen section for illumination of each screen section for visibility during periods of limited light condition, such as during the evening hours. Further, a support member with handles mounted on each end thereof is provided for transport of the apparatus when the apparatus is inter-rolled about itself.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wind screen apparatus which has all the advantages of the prior art wind screen apparatus and none of the disadvantages.

It is another object of the present invention to provide a new and improved wind screen apparatus which may be easily and efficiently manufactured and marketed.

It is a further object of the present invention to provide a new and improved wind screen apparatus which is of a durable and reliable construction.

An even further object of the present invention is to provide a new and improved wind screen apparatus which is susceptible of a low cost of manufacture with regard to both materials and labor, and which accordingly is then susceptible of low prices of sale to the consuming public, thereby making such wind screen apparatus economically available to the buying public.

Still yet another object of the present invention is to provide a new and improved wind screen apparatus which provides in the apparatuses and methods of the prior art some of the advantages thereof, while simultaneously overcoming some of the disadvantages normally associated therewith.

Still another object of the present invention is to provide a new and improved wind screen apparatus wherein the same is selectively arranged about an associated blanket to afford protection from wind directed onto the blanket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view taken in elevation of the wind screen sections and support posts.

FIG. 4 is an isometric illustration of the relationship of a respective post and securement tube of the instant invention.

DESCRIPTION OF THE PREFERRED EMBODIMENT

Figure 1:
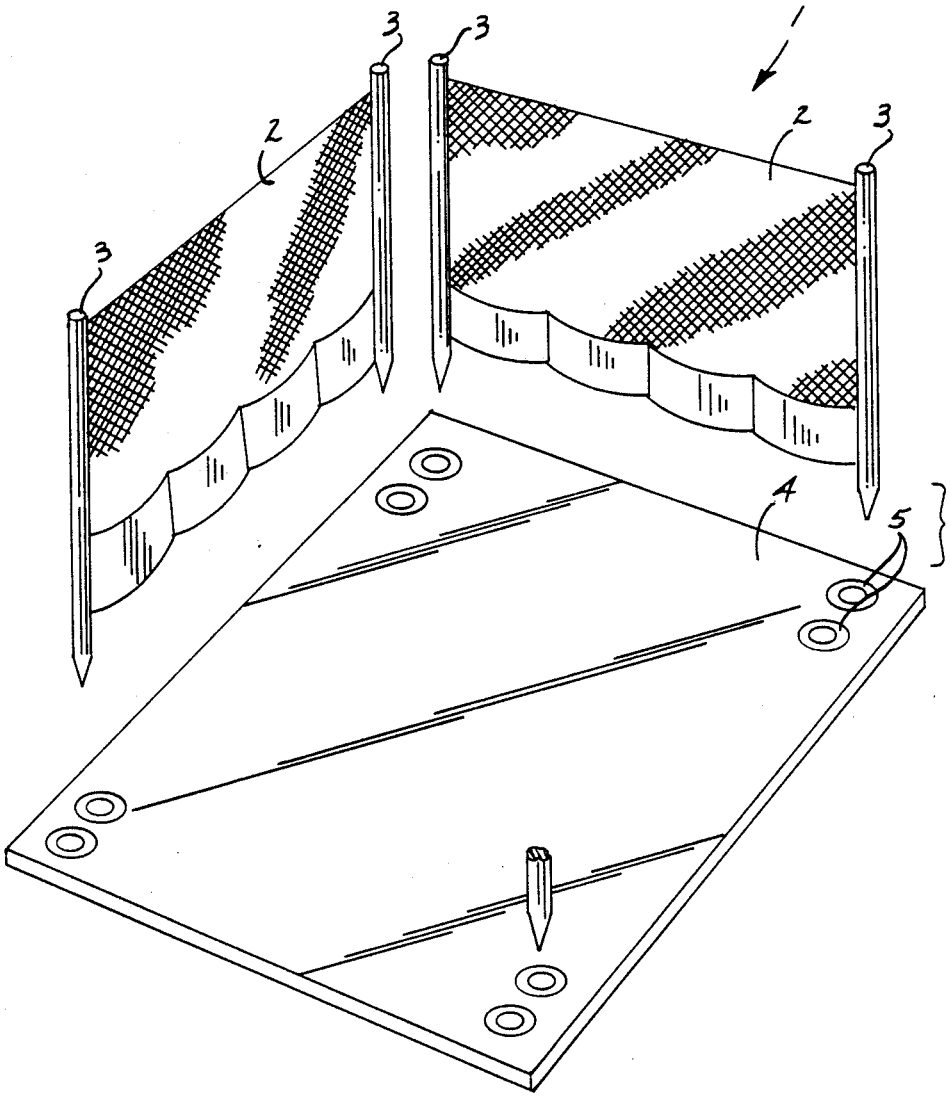
FIG. 1 is an isometric illustration of a prior art wind screen apparatus.

With reference now to the drawings, and in particular to FIGS. 1 to 8 thereof, a new and improved wind screen apparatus embodying the principles and concepts of the present invention and generally designated by the reference numeral 10 will be described.

More specifically, the wind screen apparatus 10 comprises an improvement over the prior art device as illustrated in FIG. 1, wherein the wind screen 1 includes separate wind screen units defined by a single wind screen section 2 spanning the distance between associated support posts 3 and secured integrally thereto, and wherein the support posts are directed through apertures 5 within an associated blanket 4.

Figures 2, 2A:
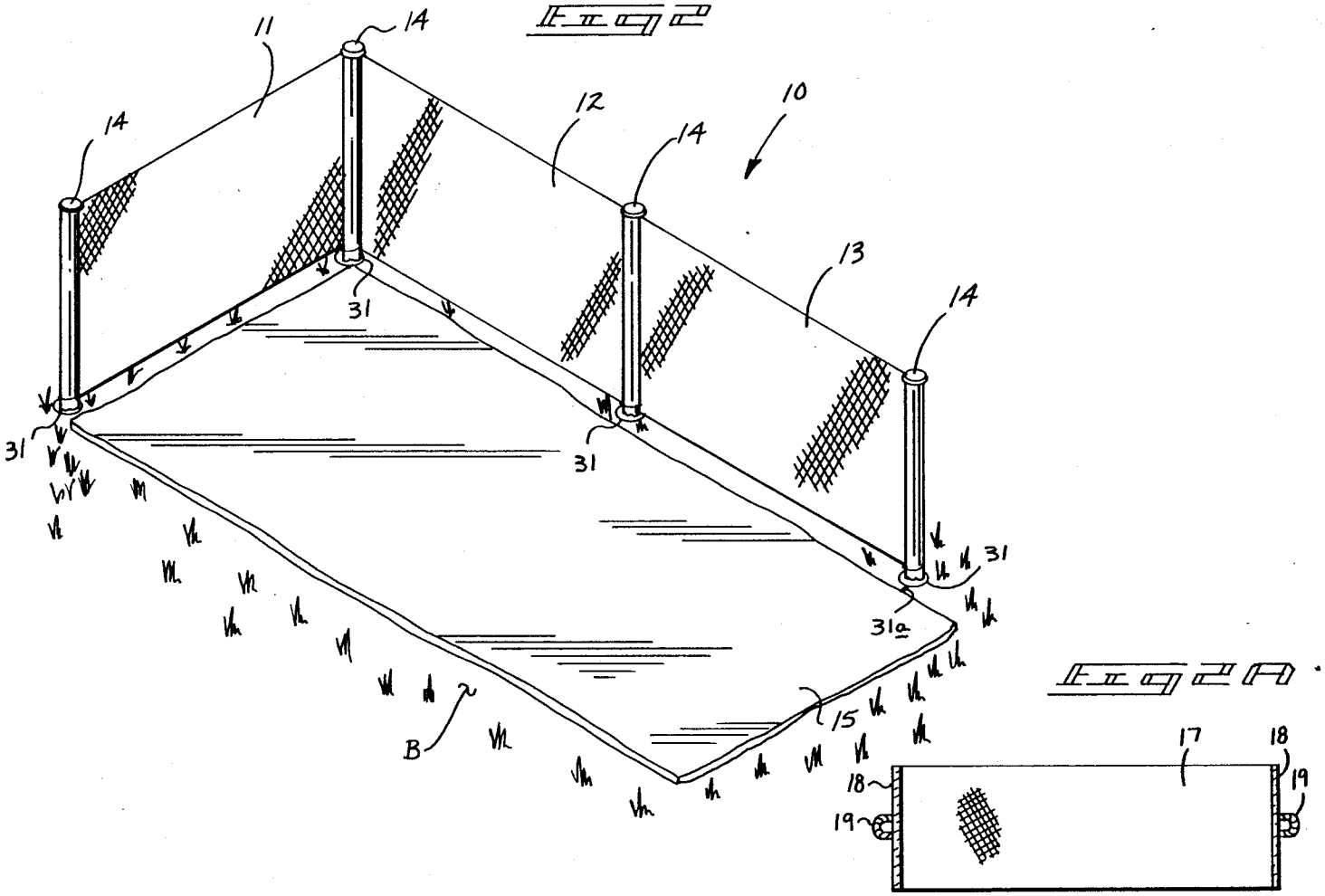
FIG. 2 is an isometric illustration of the wind screen apparatus of the instant invention.
FIG. 2*a* is a top orthographic view of a carrier for the wind screen apparatus, as illustrated in FIG. 2.

The wind screen apparatus 10 of the instant invention, as illustrated in FIG. 2 for example, includes a series of wind screen sections defined by a first wind screen section 11, a second wind screen section 12, and a third wind screen section 13. The wind screen sections are secured between replaceable support posts 14 defined by a predetermined diameter to interconnect the wind screen sections 11, 12, and 13 in a continuous span. The lowermost ends 14*a* of the post 14 are of a pointed tapered configuration for directing the posts within a support surface, such as the beach area "B", as illustrated in FIG. 2. An elongate blanket 15 that may be formed of an impermeable material is utilized and positioned interiorly of the configuration defined by the wind screen apparatus 10 in its assembled configuration. The fabric of the wind screen sections 11, 12, and 13 may be formed of various materials to include cotton, hemp, linen, ramie, polymerics, or a blend thereof. Further, the wind screen may be of enhanced visibility coloration to accent and provide visible notice of its position within the beach area "B". FIG. 2 further illustrates the use of anchor loops 31 that may be employed by the blanket 15, wherein the loops 31 are of a diameter greater than the predetermined diameter of each post to receive the posts therethrough and maintain the positioning of the blanket 15. The loops 31 are secured to the blanket 15 by tether lines 31*a*. FIG. 2*a* is illustrative of a support screen 17 formed of a comparable woven fabric matrix of material, as utilized in the screen sections 11 through 13, and further includes rigid end members 18 coextensive with the remote terminal ends of the support screen 17 with flexible handles 19 mounted to the end members 18, whereupon a rolling up of the screen sections 11 through 13 in association with the posts, as well as the blanket 15, enables their deposit onto the support screen 17 for transport thereof.

Figure 5:
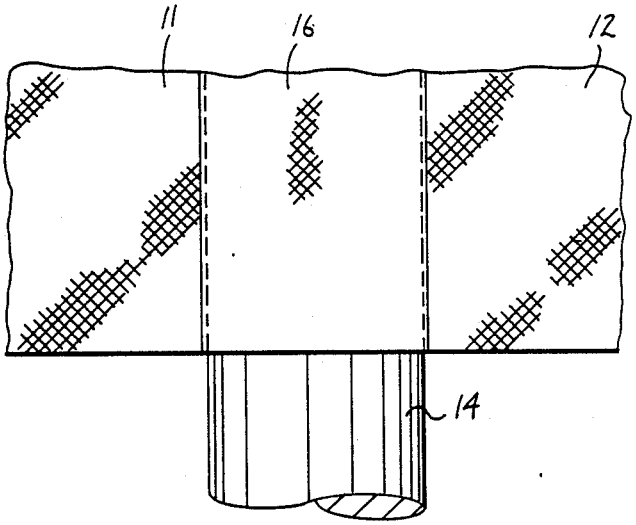
FIG. 5 is an orthographic view taken in elevation of a support post and securement tube in an assembled configuration.
Figure 6:
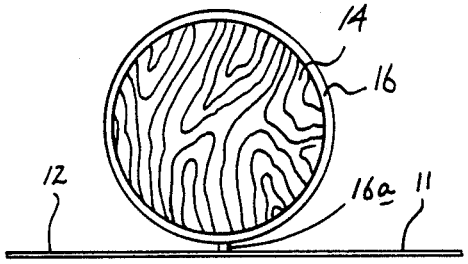
FIG. 6 is an orthographic cross-sectional view illustrating the association of a support post and securement tube of the instant invention.

FIGS. 4–6 are illustrative of the association of the support posts 14 and the associated screen sections, wherein each of the junctions of each screen section includes a securement tube 16 defining an interior diameter equal to the predetermined diameter of the posts 14 to provide a secure inter-relationship of the posts 14 within the associated tubes 16. The sliding relationship of the tubes 16 and the posts 14 enable replacement of the posts 14 due to damage and wear. Each of the tubes 16 includes a connecting web 16*a* to enable a degree of flexure of each of the tubes and associated posts relative to the screen sections 11 through 16 and their relationship to the securement tubes and posts in use.

Figures 7, 8:
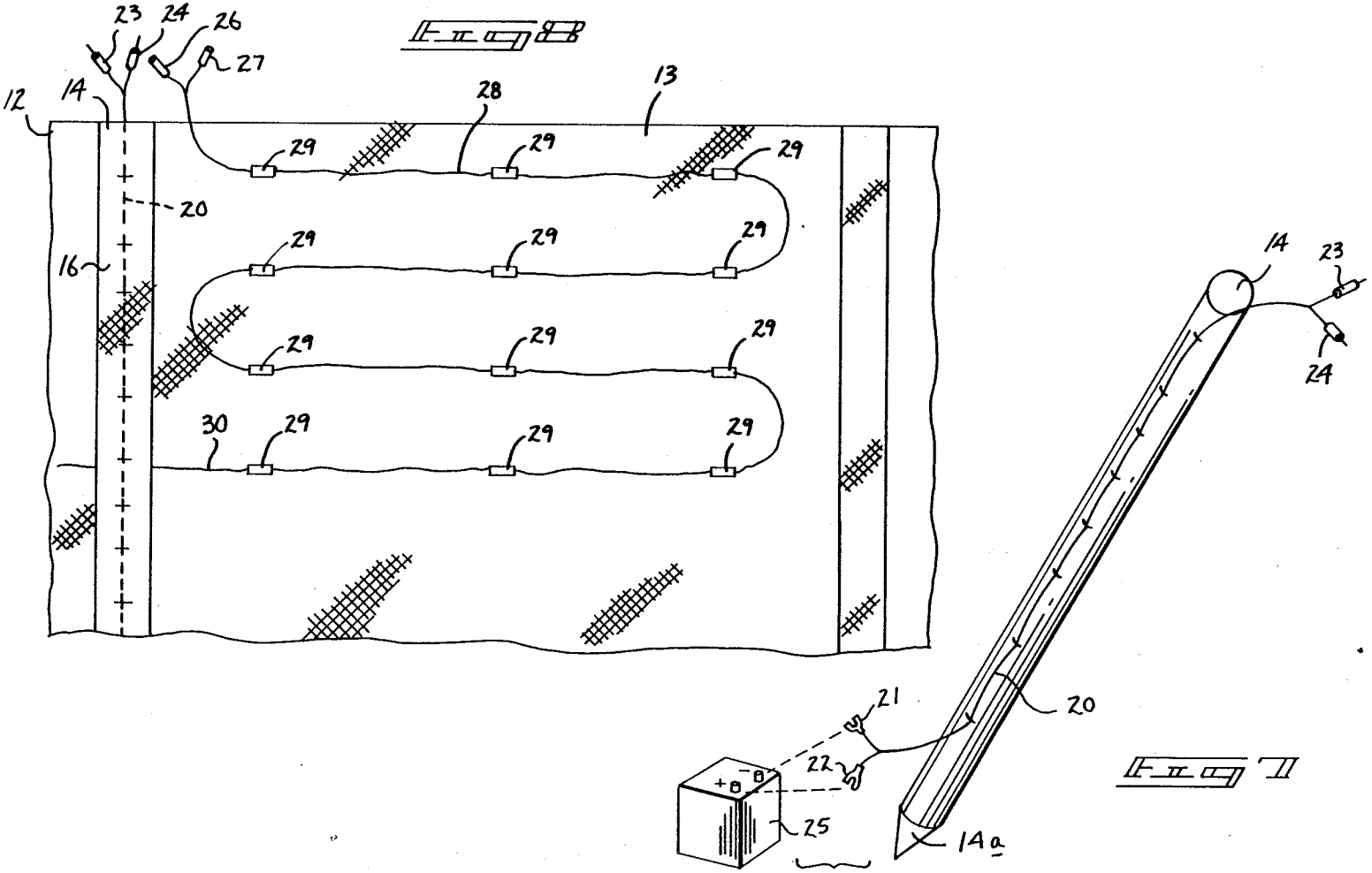
FIG. 7 is an isometric illustration of a support post of the instant invention in association with an illumination means.
FIG. 8 is an orthographic view taken in elevation of a wind screen section in association with an illumination means of the instant invention.

FIGS. 7 and 8 are illustrative of the instant invention with a lighting means in association therewith. The lighting means is for use during periods of limited lighting conditions such that the positioning of the wind screens onto the support surface, or beach "B", is visible to an individual to prevent inadvertent contact between an individual and the apparatus 10. The lighting means includes a conductive post wire 20 longitudinally secured to and aligned with each of the posts 14 to enable the post wire to be directed through an associated tube 16. The post wire 20 includes, at its lowermost terminal end, a first battery connector end 21 and a second battery connector end 22 for securement to opposed terminals of a direct current battery 25. At a remote terminal end of the post wire 20 spaced from the first and second connector ends are first and second line connectors 23 and 24 for securement to associated third and fourth line connectors 26 and 27. The line connectors 26 and 27 are in electrical communication with an illumination electrical line 28 connected in series of a plurality of illumination light members 29. A connector line 30 directs the current to associated screen sections of the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wind screen apparatus comprising, in combination, a plurality of elongate screen sections including end screen sections, and a single post member orthogonally oriented and secured to adjacent screen sections, and a further post member mounted to a free end of each end screen section, and wherein each screen section is defined by a predetermined width, and each post is of a further width greater than the predetermined width to extend beyond upper and lower edges of each screen section, and wherein each post member and each further post member includes a securement tube, each securement tube defined by a predetermined interior diameter equal to an external diameter defined by each post member and further post member, and each securement tube including a flexible web joining each securement tube to the screen sections, and wherein each screen section is joined to an adjacent screen section at an interface, and each web is coextensive with and joined to each interface, and each screen section is formed of a predetermined fabric, and each securement tube and each web is formed of the predetermined fabric, and further including a flexible blanket member, the blanket member including securement loops, the securement loops extending exteriorly of side edges of the blanket and defined by an internal diameter greater than the predetermined diameter to receive the post members and further post members therethrough, and each loop further including a tether line securing each loop to the side edge of the blanket, and further including illumination means secured to the screen sections, the illumination means including a series of illumination means mounted to a surface of each screen section, and the illumination means further including a plurality of connectors, the connectors joined to further connectors, the further connectors secured to an exterior surface of a post member, and a conductive post wire electrically communicated to the further connectors at one end and directed downwardly along the post member a length greater than the predetermined width of the screen section and emerging from a lowermost end of the respective securement tube for securement to a battery.

2. A wind screen apparatus as set forth in claim 1 further including a support screen, the support screen including remote end edges, each end edge including a rigid member integrally secured thereto, and a flexible handle secured to each rigid member wherein the support screen receives the screen sections, post members, and further post members for transport thereof.

* * * * *